US006353973B2

(12) United States Patent
Exner

(10) Patent No.: US 6,353,973 B2
(45) Date of Patent: Mar. 12, 2002

(54) CALENDER, PARTICULARLY FOR WEBS OF TEXTILE FABRIC, NON-WOVEN FABRIC, OR SYNTHETIC FABRIC

(75) Inventor: Joachim Exner, Issum (DE)

(73) Assignee: Kleinewerfers Textilmaschinen GmbH, Krefeld (DE)

( * ) Notice: Subject to any disclaimer, the term of this patent is extended or adjusted under 35 U.S.C. 154(b) by 0 days.

(21) Appl. No.: 09/770,362

(22) Filed: Jan. 25, 2001

(30) Foreign Application Priority Data

Feb. 7, 2000 (DE) ..... 100 05 306

(51) Int. Cl.[7] ..... D01G 15/40
(52) U.S. Cl. ..... 19/105; 19/65 CR; 19/106 R
(58) Field of Search ..... 19/105, 106 R, 19/108, 109, 98, 100, 296, 299, 65 CR; 38/44, 49, 51, 52, 53, 57, 58, 62; 101/22, 23, 24, 25, 32, DIG. 49

(56) References Cited

U.S. PATENT DOCUMENTS 2,669,756 A * 2/1954 Szaloki et al. ..... 19/106 R
3,305,182 A * 2/1967 Layson et al. ..... 19/65 CR
3,791,288 A * 2/1974 Whitehurst ..... 19/65 CR
4,404,711 A * 9/1983 Kluttermann ..... 19/106 R

FOREIGN PATENT DOCUMENTS

DE 3712276 10/1988

* cited by examiner

*Primary Examiner*—John J. Calvert
*Assistant Examiner*—Gary L. Welch
(74) *Attorney, Agent, or Firm*—Friedrich Kueffner

(57) ABSTRACT

A calender, particularly for webs of textile fabric, non-woven fabric or synthetic fabric, includes a frame and a first roll, a second roll and a third roll mounted on the frame. The third roll forms during operation of the calender a single nip either with the first roll or with the second roll. The first roll is movable between a work position in which it forms a nip with the third roll and a first parking position, and the second roll is movable between a work position in which it forms the nip with the third roll and a second parking position, wherein the work positions coincide and the parking position of each roll is located at such a distance from the third roll that a movement of the respectively other roll between the work position and the parking position is possible.

16 Claims, 3 Drawing Sheets

CALENDER, PARTICULARLY FOR WEBS OF TEXTILE FABRIC, NON-WOVEN FABRIC, OR SYNTHETIC FABRIC

BACKGROUND OF THE INVENTION

1. Field of the Invention

The invention relates to a calender, particularly for webs of textile fabric, non-woven fabric, or synthetic fabric, with a frame and a first roll, a second roll and a third roll mounted in the frame, wherein the third roll forms during operation a single nip either with the first roll or with the second roll.

2. Description of the Related Art

A calender of the above-described type is sold by Kleinewerfers Textilmaschinen GmbH in the form of a three-roll calender with rolls arranged one above the other. The nip is in this calender formed either between the upper roll and the middle roll or between the lower roll and the middle roll. The two different pairings of rolls are necessary in order to be able to switch over as soon as possible and without major reassembly from one manner of treatment to another manner of treatment. For example, it may be necessary to treat the fabric web with different surface qualities of the upper and the lower rolls. Another situation occurs when it is desired to change the treatment temperature of the fabric web. Since the temperature change in the heated roll can be carried out only at about 1° C. to 2° C. per minute in order to avoid undue thermal stresses, a temperature change of 40° C. will take a relatively long time. On the other hand, if it is possible to change to a roll which already has the required temperature, the time required for changing between the two types of treatment is drastically shortened.

Consequently, in the known calender, the travel path of the fabric web is changed when changing from one manner of treatment to another. Thus, if the fabric web has been fed to the upper nip, i.e., the nip between the upper roll and the middle roll, the fabric web is then supplied for the changed treatment to the lower nip, i.e., the nip between the lower roll and the middle roll. The nip which is not in use remains open. A calender of the above-described type has been found acceptable in principle for different treatment possibilities of fabric webs. However, the change of one type of treatment in one nip to another type of treatment in the other nip is relatively cumbersome. In particular, the path along which the fabric web is guided must be changed. This is true for the entry side as well as the exit side. If the fabric web is a non-woven fabric which is to be bonded in the nip, for example, a supply belt on which the fabric is supplied to the nip must be pivoted. The fabric web must either travel with a different travel path through cooling rolls which as a rule are arranged at the exit of the nip, or the position of the cooling rolls must also be changed.

A calender of the above-described type is also known from DE 37 12 276 C1. In one embodiment of this calender, three rolls are arranged one above the other, wherein the middle roll can be moved either upwardly to form a nip with the upper roll, or downwardly to form a nip with the lower roll. The fabric web is supplied through a pivotable supply unit whose supply path ends either a short distance below the upper roll or a short distance above the lower roll. The fabric web leaving the respective nip is guided either from below or from above around a guide roll and leaves the calender in a slightly upwardly or downwardly inclined direction.

SUMMARY OF THE INVENTION

It is the primary object of the present invention to facilitate the change from one type of operation to another type of operation.

In accordance with the present invention, in a calender of the above-described type, the first roll is movable between a first work position in which it forms the nip with the third roll and a first parking position, and the second roll is movable between a work position in which it forms the nip with the third roll and a second parking position, wherein the two work positions coincide and the parking positions of each of the first and second rolls is distanced from the third roll by such a distance that a movement of the respectively other roll between the work position and the parking position is possible.

The statement that the two work positions coincide does not mean that they coincide in the mathematical sense. Smaller deviations are permissible as long as the nip, which is formed by the respective first or second roll which is in the work position with the third roll, produces essentially the same treatment result, independently of which roll is at a given time in the work position. Of course, this is only true if the first and second rolls are equal. However, the first and second roll will normally be of different construction. The differences may be in the surface structure or in the material if the first or second rolls or both rolls are constructed as engraved rolls. The differences may also be in the temperature or in other physical properties. A change in the type of operation from a treatment in the nip between the first and second rolls to a treatment in the nip between the second and third rolls is relatively simple. In particular, it is not necessary to change the entry travel path or the exit travel path of the fabric web. It is merely necessary to move the roll which prior to the change of the type of operation was in the work position into its parking position and to move the other roll from its parking position into the work position. Such movements can be carried out substantially simpler than the change of a travel path. It is merely a prerequisite that the roll in the parking position leaves room for the movement of the other roll from the work position into the parking position and vice versa.

In accordance with a preferred embodiment, the first roll and the second roll are each movable together with their drive and possibly supply units. Accordingly, each roll when moved takes along with it its drive and possibly its supply unit, for example, required for achieving a predetermined temperature. Accordingly, when changing from one type of operation with the first roll to another type of operation with the second roll, it is actually only necessary to move the respective roll. It is not necessary to provide new connections or to connect drives to the respective roll. The roll which is in the parking position can continue to rotate with a rate of rotation independent of the production speed, for example, for cooling the roll.

In accordance with a preferred embodiment, the first roll is mounted on the frame through a first pivoting lever and the second roll is mounted on the frame through a second pivoting lever, wherein each pivoting lever is pivotable about a pivot axis. The movement of the rolls can be carried out quickly and without problems with a pivoting movement. During the pivoting movement, the pivoting lever is secured to the pivot axis. Consequently, the pivot lever always has a defined position relative to the frame, so that the control of the movement is very simple.

Each pivoting lever can preferably be secured relative to the frame on the side of a press plane located opposite the pivot axis, wherein the press plane extends through the two roll axes of the rolls forming the nip. This takes into consideration that for treating the fabric web the third roll is pressed with a certain force against the roll located in the work position. The first or second roll located in the work position is secured through the pivot axis to the frame. However, without the additional attachment of the pivoting lever, a relatively large moment would act on the pivoting lever, wherein the moment is difficult to absorb. By attaching the pivoting lever to the frame on both sides of the press plane, this problem is eliminated. The attachment can also be carried out indirectly at least on one side.

In accordance with a preferred feature, the pivoting lever located in the work position can be locked to the pivoting lever in the parking position. This does not result in an indirect locking of the pivoting lever in the working position to the housing. Rather, the pivoting lever is locked directly through the respectively other pivoting lever. However, this type of connection forms a triangle formed by the pivot axes of the two pivot levers and the locking point between the two pivoting levers. Such a triangle provides sufficient stability for supporting the pivoting lever, or the first or second roll which may be in the work position, against the forces exerted by the third roll.

In accordance with a preferred feature, each pivoting lever has a first bore which can be aligned with a second bore in the respectively other pivoting lever, wherein a bolt can be inserted into the two bores parallel to the pivot axes. Consequently, each pivoting lever has two bores, wherein the bore of one pivoting lever is in alignment with the other bore of the other pivoting lever if the one pivoting lever is in the work position. The insertion of a bolt through the aligned bores poses no problems. The bolt can be inserted either manually or a hydraulic cylinder or another drive can be used. The arrangement of bores permits a quick and reliable locking between the levers.

Each pivoting lever preferably has an adjusting device for its work position. The adjusting device has two purposes. First, the adjusting device determines the position of the pivoting lever relative to the frame in such a way that the roll located at the respective pivoting lever is in the correct position relative to the third roll. On the other hand, the adjusting device also ensures that the first bore of the respective pivoting lever in the work position can be aligned with the respective second bore of the other lever in the parking position.

The adjusting device preferably has a first adjusting unit which cooperates with the frame. This adjusting unit is used to adjust the pivoting angle of the pivoting lever relative to the frame. In principle, the vertical position of this bore in relation to the first bore is adjusted by this adjusting unit.

The adjusting device preferably also has a second adjusting unit which interacts with the respectively other pivoting lever. The second adjusting unit has basically no influence on the position of the pivoting lever which is in the work position relative to the housing. However, the second adjusting unit forms a limit for the pivoting movement of the pivoting lever in the parking position and, thus, facilitates an adjustment of the second bore of the pivoting lever in the parking position in the horizontal direction, i.e., perpendicularly of the possible movement direction of the first bore of the pivoting lever in the work position. This makes it possible to achieve an alignment of the two bores in a relatively simple manner. The adjustment is basically only necessary during the startup and possibly during a subsequent maintenance operation. The adjustment is not changed when the pivoting lever is pivoted.

Each pivoting lever preferably has a stop for its parking position. This stop limits the movement of the pivoting lever and the load of the pivoting drive is kept small.

Each pivoting lever is preferably inclined in its parking position at most to such an extent that the other pivoting lever can be pivoted without collision relative to the first pivoting lever into its parking position. This keeps low any torque which is formed by the center of gravity of the pivoting lever in the parking position and the horizontal distance from the pivoting axis. This eliminates the load on the pivoting drive in the parking position. In the work position, the pivoting lever is already directly or indirectly supported on the frame, so that there is also no load on the pivoting drive in the work position. The pivoting drive actually has only to be used in the phases of movement between the parking position and the work position. Thus, the angle is kept as small as possible.

The pivoting levers are preferably two-arm levers, wherein the respective roll is arranged on one side of the pivoting lever and a pivoting drive acts on the other side of the lever. As a result, the pivoting drive does not impair the operation of the roll and vice versa. This means that a wide variety of pivoting drives can be used.

In accordance with an advantageous feature, each pivoting lever is constructed with two walls and surrounds both sides of bearing lug of the frame. This results in a very stable support of the pivoting lever in the frame which reliably prevents tilting of the pivoting lever relative to the housing in a direction other than the pivoting direction.

In accordance with another preferred feature, each pivoting lever has at its end facing the other pivoting lever a locking plate which can be inserted between the two walls of the other pivoting lever. Also in this case, a very stable connection is obtained when locking the levers by inserting the locking plate between the two walls of the other pivoting lever.

The rolls are advantageously releasably connected to the pivoting levers. For example, the bearings on which the rolls are rotatably mounted can be fastened through a screw connection to the pivoting levers. This simplifies the exchange of rolls which occasionally becomes necessary.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
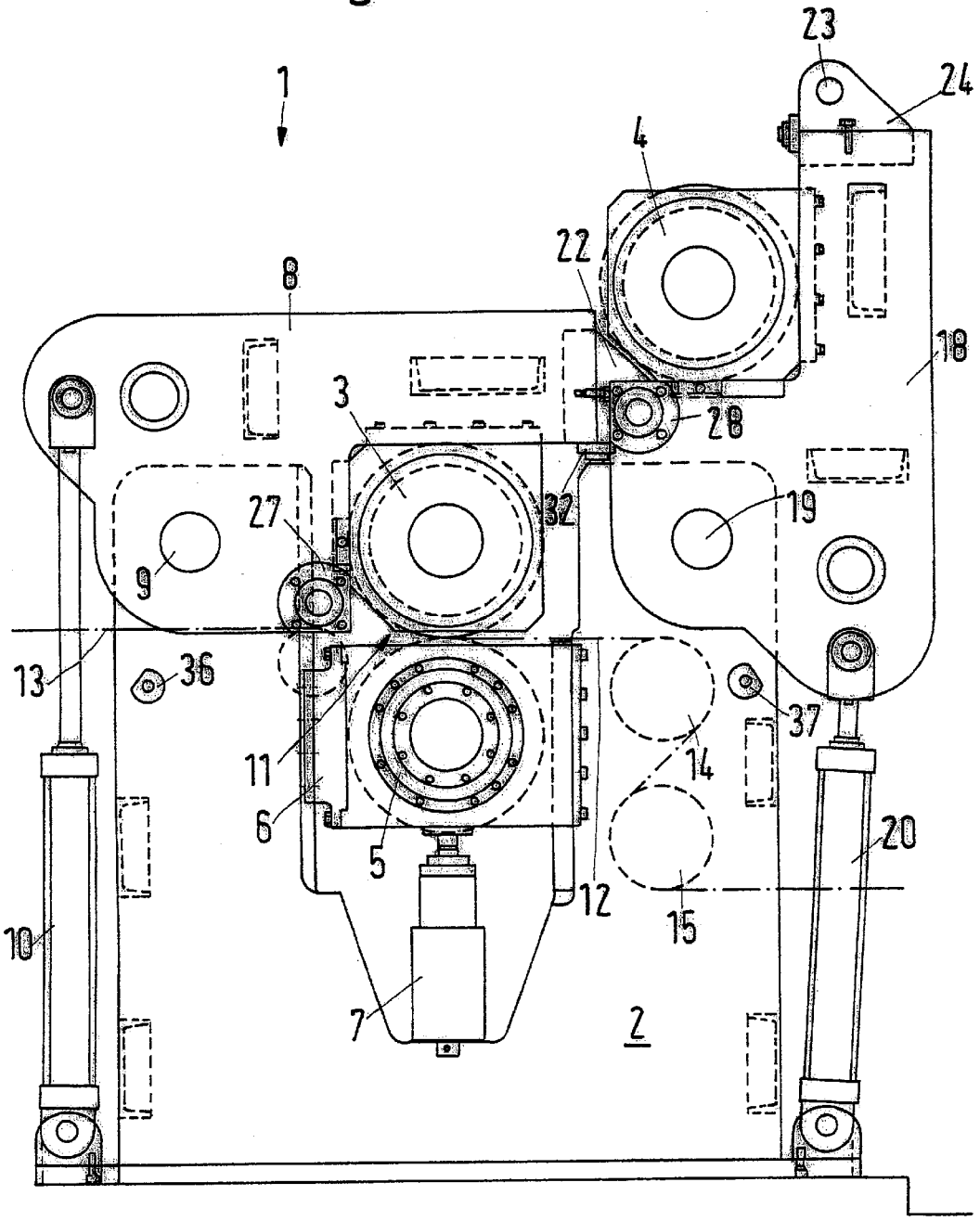
FIG. 1 is a side view of a calender during operation.

FIG. 1 of the drawing shows a calender 1 with a frame 2 and first roll 3, a second roll 4, and third roll 5 mounted in the frame 2. The third roll 5 is mounted in a carriage 6 which can be displaced in the frame 2 by means of a hydraulic cylinder 7; in the illustrated embodiment, the displacement of the carriage 6 is in the vertical direction. However, the hydraulic cylinder 7 not only serves for displacing the carriage 6 and the third roll 5, but also for adjusting the third roll 5 against the first or second roll and for applying a force by the roll 5 against the first or second rolls, as will be explained below.

The first roll 3 is mounted on a first pivoting lever 8 which can be pivoted about a pivot axis 9 relative to a frame 2. For this purpose, the first pivoting lever 8 has a pivoting drive 10. The first pivoting lever 8 is constructed as a two-arm lever. The first roll 3 is mounted on one side of the pivot axis 9; in the illustrated embodiment, the first roll 3 is arranged on the right of the pivot axis 9. The pivoting drive 10 acts on the other side, i.e., on the left in the illustrated embodiment. When the first pivoting lever 8 has been pivoted in such a way as it is illustrated in FIG. 1, the first roll 3 is in its work position, i.e., it forms with the third roll 5 a nip 11 through which a fabric web 12 can be guided and in which pressure and possibly increased temperature can be applied to the fabric web 12.

The fabric web 12 is supplied to the nip 11 by means of a screen 13 or by means of another conveying device. This screen 13 may be stationary, i.e., the fabric web 12 is always guided through the nip 11 in the illustrated manner.

Two cooling rolls 14, 15 are arranged at the exit side of the nip 11; the fabric web 12 is guided partially around each cooling roll 14, 15. These cooling rolls 14, 15 also remain stationary and the fabric web 12 is always guided in the same manner around the cooling rolls 14, 15 independently of the manner of treatment of the fabric web in the calender 1.

The second roll 4 is mounted in a similar manner on a second pivoting lever 18 which can be pivoted about a pivot axis 19 and includes a pivoting drive 20. As illustrated, the pivoting drives 10, 20 are constructed as hydraulic cylinders. The pivot axes 9, 19 are formed by bolts which are attached to the frame 2. In FIG. 1, the second roll 4 is in the parking position.

The rolls 3, 4, 5 have a diameter in the order of magnitude of 400–900 mm, wherein the third roll 5 as a rule has a slightly smaller diameter than the first roll 3 or the second roll 4.

Figure 2:
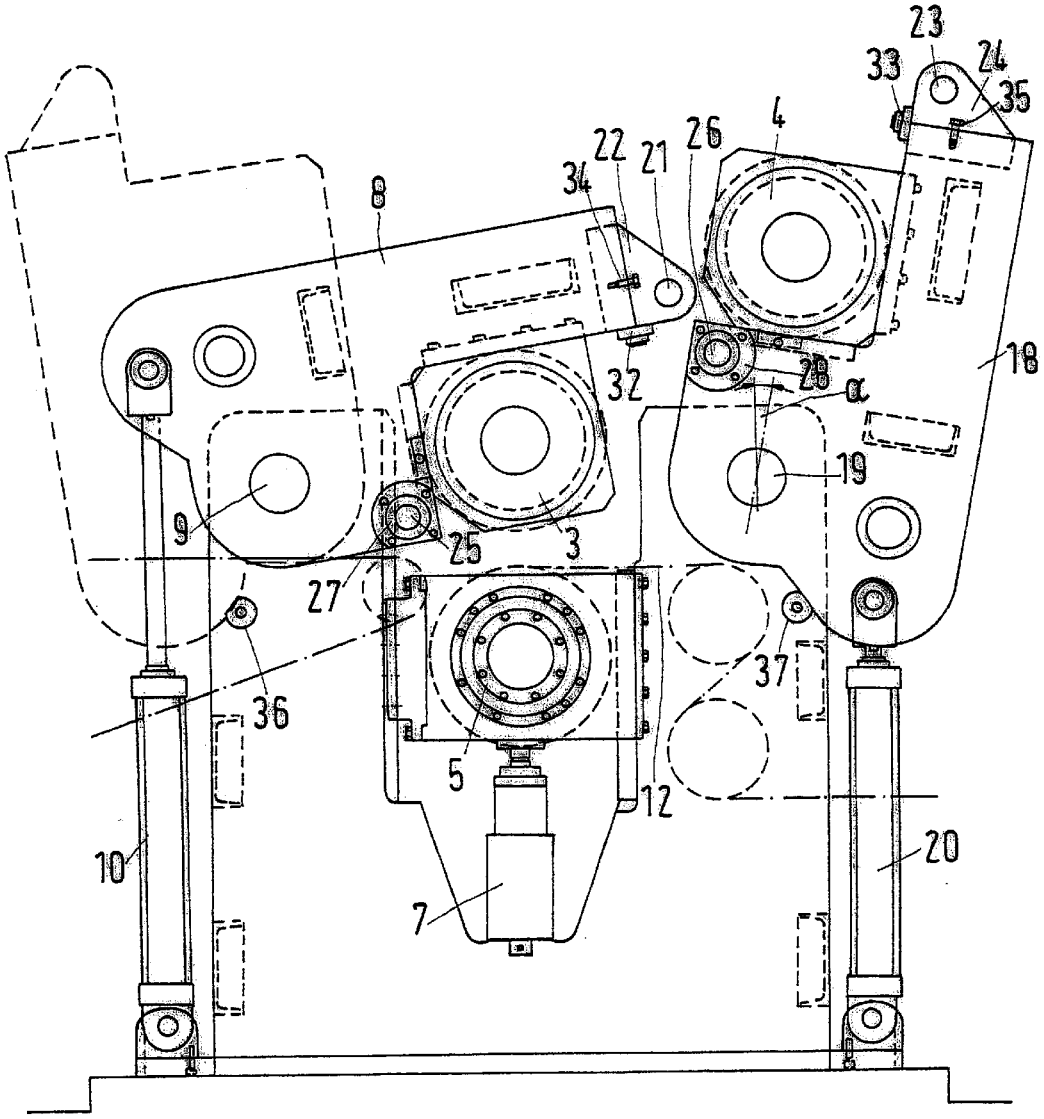
FIG. 2 shows the calender of FIG. 1 during a change of the type of operation of the calender.

As mentioned above, the third roll 5 is pressed by means of the cylinder 7 against the first roll 3 which is in the work position. Without additional measures, this would result in a pivoting movement of the first pivoting lever 8. In order to prevent this, the first pivoting lever 8 is locked to the second pivoting lever 18. This is illustrated in FIG. 2. The first pivoting lever 8 has a first opening 21 provided in a first locking plate 22 which is arranged at the tip of the first pivoting lever 8, i.e., at that end which is directed toward the second pivoting lever 18 when the first pivoting lever is located in the work position illustrated in FIG. 1. In the same manner, the second pivoting lever has a first opening 23 in its locking plate 24.

The first pivoting lever 8 has a second opening 25. The second pivoting lever 18 has a second opening 26. Arranged at both second openings 25, 26 is a hydraulic cylinder 27, 28 each which acts parallel to the pivot axes 9, 19, i.e., perpendicularly of the plane of the drawing in the illustrations of FIGS. 1 and 2.

Figure 3:
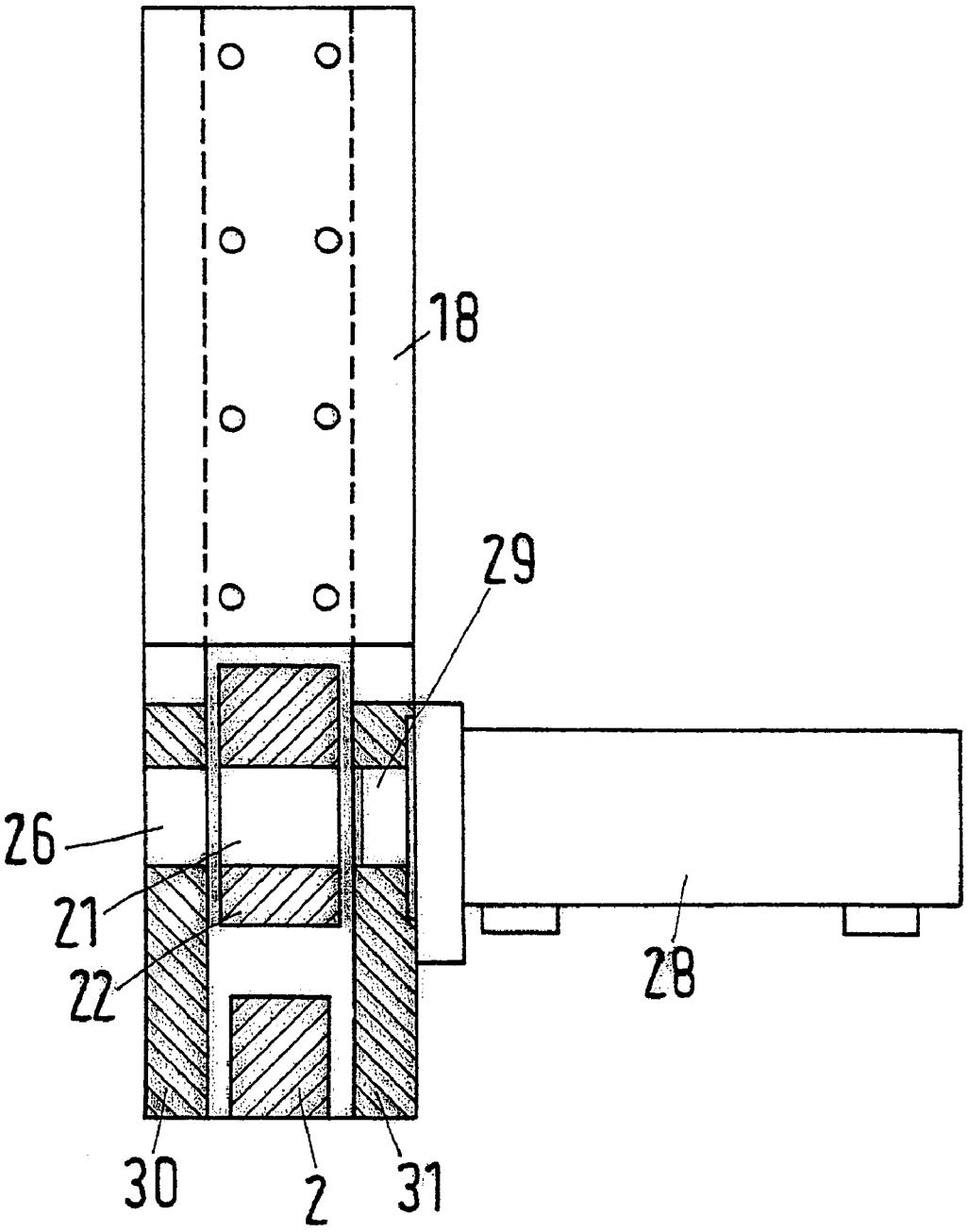
FIG. 3 is a view, on a larger scale, of a locking device.

When the first pivoting lever 8 has been moved into the work position and the second pivoting lever 18 has been moved into the parking position, the first opening 21 of the first pivoting lever 8 and the second opening 26 of the second pivoting lever 18 are in alignment. As can be seen in FIG. 3, the cylinder 28 can then push a bolt 29 into the openings, so that the first pivoting lever 8 and the second pivoting lever 18 are locked together. This means that the first pivoting lever 8 is indirectly secured relative to the frame 2. The two pivot axes 9, 19 and the locking point resulting from the bolt 29 form a triangle which is stable enough to support the first roll 3 relative to forces exerted by the cylinder 7.

As FIG. 3 further shows, the second pivoting lever 18 is a double-walled lever (the same is true for the first pivoting lever 8), i.e., the pivoting lever 18 has two walls 30, 31 between which the locking plate 22 of the first pivoting lever 8 can be inserted. In the same manner, the frame 2 is received between the two walls 30, 31. The frame 2 may have a smaller thickness and form a bearing lug at this location.

For ensuring the alignment of the first bores 21, 23 with the second bores 25, 26 of the respectively other pivoting lever after a pivoting movement has been carried out, each pivoting lever 8, 18 has an adjusting device. The adjusting device includes a first adjusting unit 32, 33 in the form of an adjusting screw. As can be seen in FIG. 1, the adjusting screw 32 of the first pivoting lever 8 rests in the work position against the frame 2. By changing the length of the adjusting screw 32, the vertical position of the opening 21 of the first pivoting lever 8 is essentially adjusted.

The adjusting device further has a second adjusting unit 34 (at the first pivoting lever) and 35 (at the second pivoting lever) which are also constructed as adjusting screws. The adjusting unit 34 at the first pivoting lever 8 limits a pivoting movement of the second pivoting lever 18 toward the first pivoting lever 8. This essentially secures the position of the second opening 26 in the second pivoting lever 18 in the horizontal direction. Consequently, by an interaction of the two adjusting units 32, 34 at the first pivoting lever or the two adjusting units 33, 35 at the second pivoting lever, an alignment of the respective bores 21, 26 and 23, 25 can be achieved in a relatively simple manner.

When the manner of operation is to be changed, i.e., the fabric web 12 is no longer to be treated between the first roll 3 and the third roll 5, but in a nip between the second roll 4 and the third roll 5, initially the locking device between the first pivoting lever 8 and the second pivoting lever 18 is released by moving the bolt 29 back by means of the cylinder 28. Next, the second pivoting lever 18 is pivoted outwardly by means of its pivoting drive 20, as can be seen in FIG. 2. This movement can be limited by a stop 37 in such a way that the angle of inclination of the pivoting lever relative to the vertical direction is limited to a maximum value; a corresponding stop 36 is provided for the first pivoting lever 8. This provides sufficient space for making it possible to pivot the pivoting lever 8 past the second roll 4 into the parking position illustrated in broken lines in FIG. 2. However, the angle remains small. As a result, the first pivoting lever 8 with its first roll 3 now has made available sufficient space for making it possible to pivot the second pivoting lever 18 in a counterclockwise direction for moving the second roll 4 into the vicinity of the third roll 5. Since the third roll 5 has been lowered by the cylinder 7 prior to the change of operation, as a rule by 120 mm, the second roll 4 forms an open nip with the third roll 5. Before the calender can be operated once again, the first pivoting lever is moved from the position shown in broken lines in which it rests against the stop 36, once again back slightly in the clockwise direction in such a way that the first roll 3 is located approximately vertically above the pivot axis 9. In this position, the first pivoting lever then rests against the second adjusting unit 35 of the second pivoting lever 18 and the openings 23 and 25 are in alignment, so that the cylinder 27 can insert a locking bolt into the aligned openings. When the cylinder 7 then moves the third roll 5 against the second roll 4, the treatment of the fabric web 12 is then possible with the desired pressure and temperature. The arrangement is then basically mirror-symmetrical relative to the arrangement illustrated in FIG. 1.

While specific embodiments of the invention have been shown and described in detail to illustrate the inventive principles, it will be understood that the invention may be embodied otherwise without departing from such principles.

I claim:

1. A calender, particularly for webs of textile fabric, non-woven fabric or synthetic fabric, the calender comprising a frame and a first roll, a second roll and a third roll mounted in the frame, wherein during operation of the calender the third roll forms a nip either with the first roll or the second roll, wherein the first roll is mounted so as to be movable between a work position in which the first roll forms the nip with the third roll and a first parking position, wherein the second roll is mounted so as to movable between a work position in which the second roll forms the nip with the third roll and a second parking position, wherein the work positions of the first and second rolls coincide, wherein the parking position of the first roll is located at a distance from the third roll such that the movement of the second roll between the work position and vise versa the second parking position is possible, and wherein the parking position of the second roll is located at a distance from a third roll such that the movement of the first roll between the working position and the first parking position is possible.

2. The calender according to claim 1, wherein the first and second rolls each have a drive device, wherein the supply devices are mounted so as to be movable together with the first and second rolls.

3. The calender according to claim 1, wherein the first and second rolls each have a supply device, wherein the drive devices are mounted so as to be movable together with the first and second rolls.

4. The calender according to claim 1, wherein the first roll is mounted on the frame through a first pivoting lever and the second roll is mounted on the frame through a second pivoting lever, wherein each pivoting lever is pivotable about a pivot axis.

5. The calender according to claim 4, comprising locking means for locking each pivoting lever relative to the frame on a side of a press plane extending through roll axes of the rolls forming the nip, wherein the press plane is located on each pivoting lever on a side opposite the pivot axis.

6. The calender according to claim 5, comprising means for locking one of the pivoting levers in the work position relative to another of the pivoting levers in the parking position.

7. The calender according to claim 6, wherein each pivoting lever has a first bore and a second bore, wherein the pivoting levers are configured such that the first bore of one pivoting lever is movable into alignment with the second bore of another of the pivoting levers, wherein the locking means comprise a bolt insertable parallel to the pivot axes through the aligned bores.

8. The calender according to claim 4, wherein each pivoting lever has an adjusting device for adjusting the work position thereof.

9. The calender according to claim 8, wherein each adjusting device comprises a first adjusting unit for interacting with the frame.

10. The calender according to claim 9, wherein each adjusting device comprises a second adjusting unit for interacting with another of the pivoting levers.

11. The calender according to claim 8, wherein each pivoting lever has a stop for the parking position thereof.

12. The calender according to claim 4, wherein each pivoting lever is configured to have a maximum inclination in the parking position thereof, such that the movement of one pivoting lever into the parking position thereof is effected without collision with the other of the pivoting levers.

13. The calender according to claim 4, wherein each pivoting lever is comprised of two sides, wherein each roll is mounted on one side of the pivot axis and a pivoting drive acts on another side of the pivot axis.

14. The calender according to claim 4, wherein the frame has a bearing lug, and wherein each pivoting lever has two walls for engaging the bearing lug on both sides thereof.

15. The calender according to claim 14, wherein each pivoting lever has at an end thereof facing the other pivoting lever a locking plate, wherein the locking plate is insertable between the walls of the other pivoting lever.

16. The calender according to claim 4, wherein the rolls are releasably mounted on the pivoting levers.

* * * * *